US007963887B2

(12) United States Patent
Ozawa et al.

(10) Patent No.: US 7,963,887 B2
(45) Date of Patent: Jun. 21, 2011

(54) EXERCISE ASSIST DEVICE

(75) Inventors: Takahisa Ozawa, Katano (JP); Minoru Kawamoto, Hikone (JP); Yuritsugu Toyomi, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 103 days.

(21) Appl. No.: 12/597,186

(22) PCT Filed: Apr. 25, 2007

(86) PCT No.: PCT/JP2007/058925

§ 371 (c)(1),
(2), (4) Date: Oct. 23, 2009

(87) PCT Pub. No.: WO2008/136102

PCT Pub. Date: Nov. 13, 2008

(65) Prior Publication Data

US 2010/0093495 A1 Apr. 15, 2010

(51) Int. Cl.
*A63B 71/00* (2006.01)

(52) U.S. Cl. ..... 482/8; 482/1; 482/9; 482/901; 434/247

(58) Field of Classification Search ..... 482/1–9, 482/33, 148, 900–902; 434/55, 247, 253; 463/36; 601/23–29
See application file for complete search history.

(56) References Cited

U.S. PATENT DOCUMENTS

| | | | | |
|---|---|---|---|---|
| 5,054,771 | A * | 10/1991 | Mansfield | 463/36 |
| 5,221,242 | A * | 6/1993 | Weber et al. | 482/79 |
| 6,379,285 | B1 * | 4/2002 | Maresh et al. | 482/57 |
| 2004/0198553 | A1 | 10/2004 | Hojo et al. | |
| 2006/0229170 | A1 | 10/2006 | Ozawa et al. | |
| 2008/0312040 | A1 | 12/2008 | Ochi et al. | |
| 2009/0017990 | A1 | 1/2009 | Ochi et al. | |

FOREIGN PATENT DOCUMENTS

| | | |
|---|---|---|
| JP | 2004-216072 | 8/2004 |
| JP | 2004-344683 | 12/2004 |
| JP | 2005-058733 | 3/2005 |
| JP | 2005-58733 | 3/2005 |
| JP | 2006-034640 | 2/2006 |

(Continued)

OTHER PUBLICATIONS

English language Abstract of JP 2007-089652, Apr. 12, 2007.

(Continued)

*Primary Examiner* — Glenn Richman

(74) *Attorney, Agent, or Firm* — Greenblum & Bernstein P.L.C.

(57) ABSTRACT

The invention allows a user to exercise effectively. A desired exercise effect is not obtained when the user puts too much weight onto a seat. To prevent this, an exercise assist device comprises a limit switch that detects whether a predetermined load (weight) is applied to foot rests, i.e., whether the user steps on the foot rests properly and exercises successfully. A control circuit controls a drive device for swinging the seat; obtains the number of successes relative to the total number of swings, and a success rate, based on detection results by the limit switch; displays the number of successes and the success rate on a display panel, and controls the rotational speed of a motor via a motor control circuit. As a result, the device determines automatically the degree of exercise proficiency of the user, and allows the user to exercise effectively in accordance with his/her degree of the proficiency.

13 Claims, 11 Drawing Sheets

FOREIGN PATENT DOCUMENTS

| | | |
|---|---|---|
| JP | 2006-34640 | 2/2006 |
| JP | 2007-89652 | 4/2007 |
| JP | 2007-089652 | 4/2007 |
| TW | M296698 | 9/2006 |
| TW | M301669 | 12/2006 |
| TW | 281856 | 6/2007 |

OTHER PUBLICATIONS

English language Abstract of JP 2006-034640, Feb. 9, 2006.
English language Abstract of JP 2005-58733, Mar. 10, 2005.

* cited by examiner

EXERCISE ASSIST DEVICE

TECHNICAL FIELD

The present invention relates to an exercise assist device which swings a seat, with a lumber portion of the user placed on the seat, so that the user puts a variable load resulting from body weight of the user on his/her legs on foot rests, thereby allowing the user to exercise.

BACKGROUND ART

The applicant had already proposed (Patent Document 1) an exercise assist device which swings a seat with a lumber portion of the user placed on the seat, so that the user puts a variable load resulting from body weight of the user on his/her legs on foot rests, and enable thereby the user to exercise the trunk and lower limbs. This exercise assist device allows the user to exercise through contraction of muscles in the thighs, also for users suffering from knee pain, for instance diabetic patients. The sugar metabolism associated with muscular contraction contributes to ameliorating lifestyle diseases and the like. The exercise assist device is also useful for building muscle in users having some lower body impairment.

When the user puts too much weight on the seat, however, the upper body is not loaded correctly on the legs, so that the load resulting from the weight of the body does not bear on the legs. This precludes achieving the desired exercise results, and is thus problematic. Expected results may therefore fail to be achieved even after exercising for a prescribed time.

Patent Document 1: Japanese Patent Application Laid-open No. 2005-58733

DISCLOSURE OF THE INVENTION

It is an object of the present invention to provide an exercise assist device that enables effective exercise.

In order to solve the above problem, the present invention is an exercise assist device having a swinging unit for swinging a seat, with the lumbar portion of a user placed on the seat, so that the user puts a variable load resulting from body weight of the user on legs on foot rests, thereby allowing the user to exercise, the exercise assist device comprising: a detector for detecting that a load equal to or greater than a predetermined value is acting on the foot rest; and a controller for modifying the way, in which the swinging unit swings the seat, in accordance with proportion of, over a predetermined number of swings, the number of times that the detector detects that the user puts on the legs a load equal to or greater than the predetermined value, or in accordance with proportion of, within a predetermined time, time that the detector detects that the user puts on the legs a load equal to or greater than the predetermined value.

In the above construction, a swinging unit swings a seat, with the lumbar portion of a user placed on the seat, so that the user puts a variable load resulting from body weight of the user on legs on a foot rests, whereby the exercise assist device allows the user to exercise. Desired exercise results cannot be obtained when the user puts too much weight on the seat during swinging of the seat. Therefore, there is provided a detector for detecting that a load equal to or greater than a predetermined value is applied to the foot rest, i.e. for detecting whether exercise is successful. To control swinging of the seat by the swinging unit, the controller calculates a success rate on the basis of the detection results by the detector, i.e. calculates the proportion of, over a predetermined number of swings, the number of times that the detector detects that the user puts on the legs a load equal to or greater than the predetermined value, or the proportion of, within a predetermined time, time that the detector detects that the user puts on the legs a load equal to or greater than the predetermined value, and modifies the way in which the swinging unit swings the seat, in accordance with the success rate.

The device can automatically determine the degree of exercise proficiency of the user, and allows the user to exercise effectively in accordance with his/her degree of proficiency.

The present invention is also an exercise assist device having a swinging unit for swinging a seat, with the lumbar portion of a user placed on the seat, so that the user puts a variable load resulting from body weight of the user on the legs on foot rests, and thereby allowing the user to exercise, the exercise assist device further comprising a detector for detecting that a load equal to or greater than a predetermined value is acting on the foot rest; and a display unit for integrating the detection results of the detector and displaying the integration results.

In the above construction, a swinging unit for swinging a seat, with the lumbar portion of a user placed on the seat, so that the user puts a variable load resulting from body weight of the user on the legs on a footrest, whereby the exercise assist device allows the user to exercise. Desired exercise results cannot be obtained when the user puts too much weight on the seat during swinging of the seat. Therefore, there is provided a detector for detecting that a load equal to or greater than a predetermined value and being applied to the foot rest, i.e. for detecting whether exercise is successful. The display means integrates the detection results of the detector, and displays the integration results. The user can check thereby whether the amount of exercise has been attained as anticipated or as targeted. The user can then, for instance, change the way in which the load resulting from body weight is applied, to afford better stepping, and can increase the amount of exercise by increasing the swing speed or the swinging stroke.

The user can exercise effectively as a result.

BEST MODE FOR CARRYING OUT THE INVENTION

Embodiment 1

Figure 1:
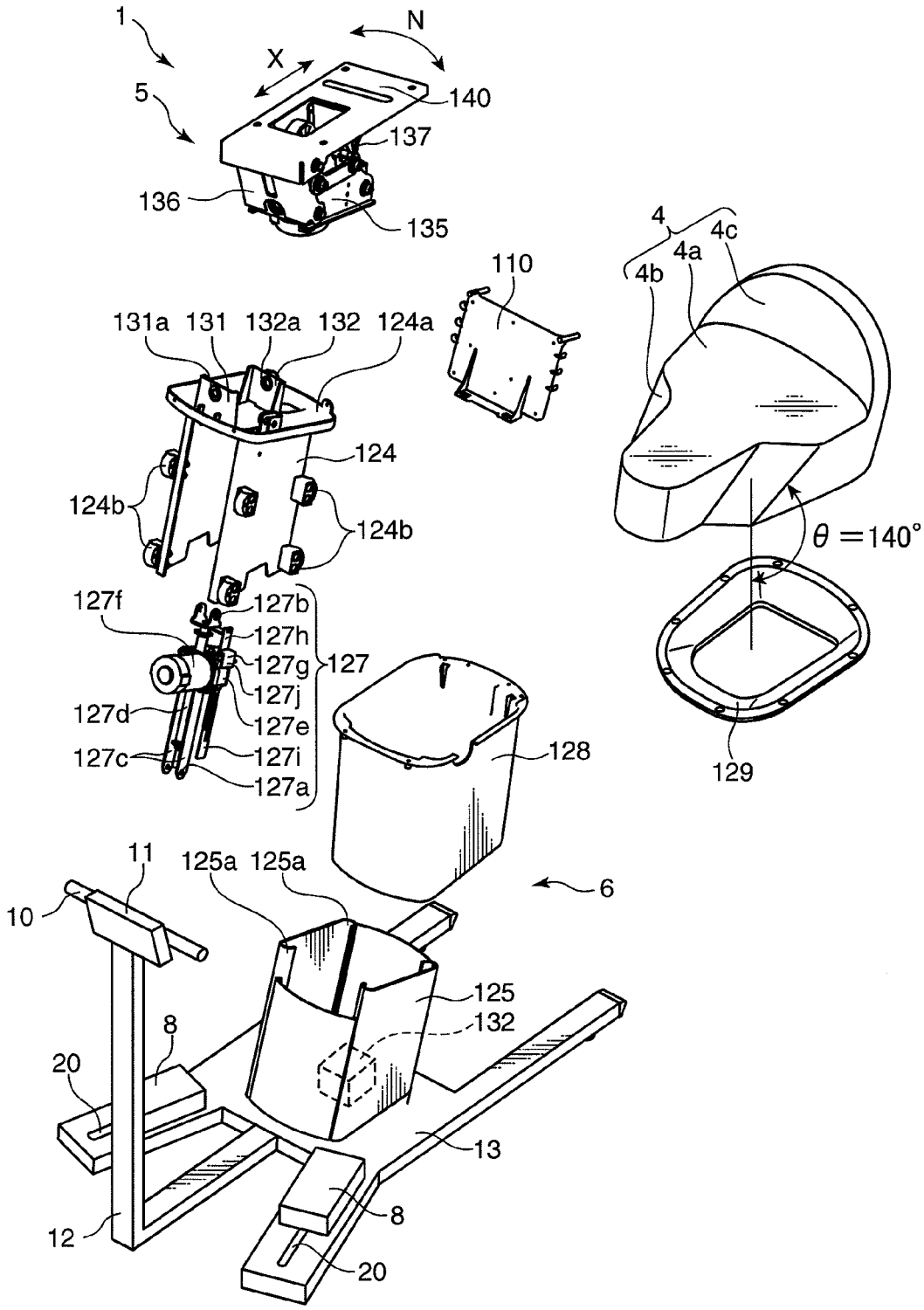
FIG. 1 is an exploded perspective-view diagram of an exercise assist device according to an embodiment of the present invention.
Figure 2B:
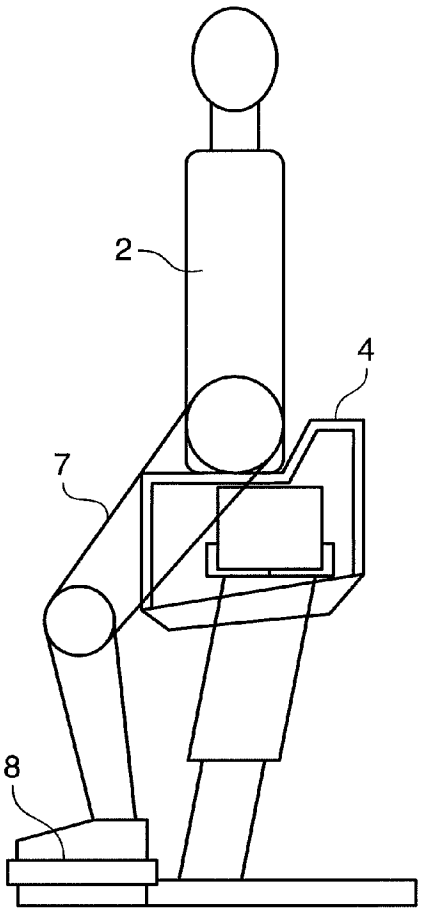
FIG. 2B is a schematic cross-sectional diagram for explaining the exercise assist device in use, with the seat in a forward-tilted state.
Figure 2A:
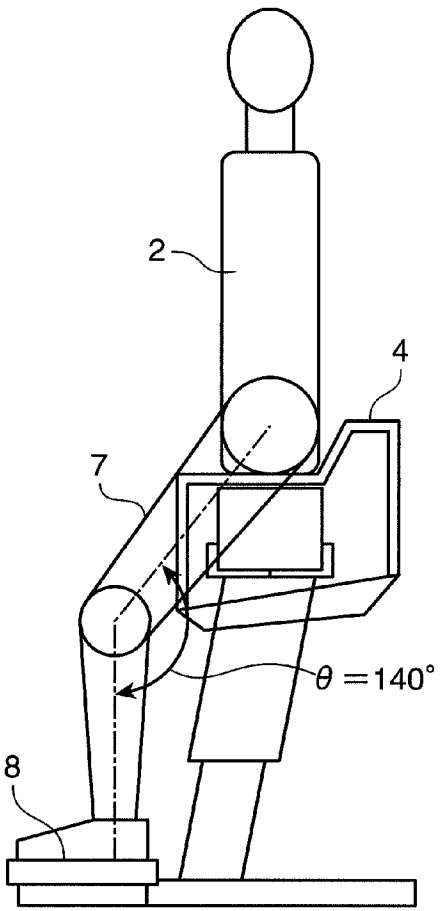
FIG. 2A is a schematic cross-sectional diagram for explaining the exercise assist device in use, with a seat in a center state.
Figure 3:
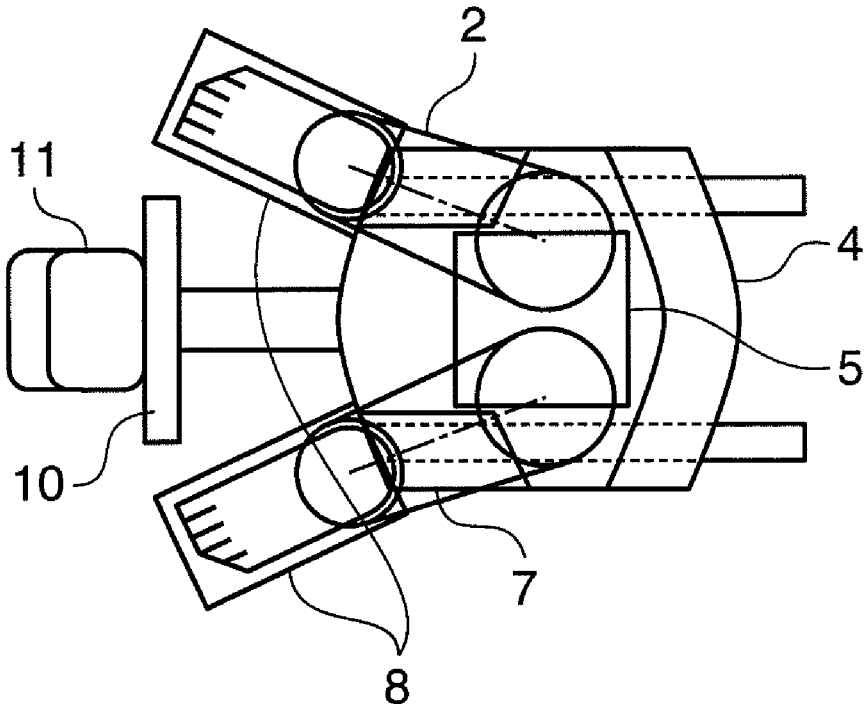
FIG. 3 is a top-side view diagram of FIG. 2A.

FIG. 1 is an exploded perspective-view diagram of an exercise assist device 1 according to an embodiment of the present invention. FIG. 2A is a schematic cross-sectional diagram for explaining the exercise assist device 1 in use, with the seat in a center state. FIG. 2B is a cross-sectional diagram of the same, in which the seat is in a forward-tilted state. FIG. 3 is a top-side view diagram of FIG. 2A.

Broadly, the exercise assist device 1 comprises a seat 4 where the lumbar portion 3 of the user 2 is rested; a drive device 5 that swings the seat 4; a shank 6 that supports the drive device 5 and the seat 4 placed thereon, wherein the shank 6 allows changing the height of the seat 4; left and right foot rests 8 that constitute the contact surfaces of the legs 7 of the user 2 and that support the weight of the legs 7; a handle 10 that supports the upper body 9; an operation panel (a display unit) 11; a strut 12 that supports the handle 10 and the operation panel 11; and a pedestal 13 onto which the shank 6, the foot rests 8 and the strut 12 are mounted. The drive device 5 swings the seat 4, thereby the drive device 5 can apply a variable load resulting from body weight of the user 2 to the legs 7 of the user 2 and allow the user 2 to exercise.

The seat 4 comprises a receiving portion 4*a* that receives the buttocks of the user 2; cutouts 4*b* formed at the front left and right, to make space for the thighs; and a raised portion 4*c* that receives the lumbar portion from the back side of the user 2. The cutouts 4*b* are formed tilted by 140° relative to the vertical (forward tilt of 50° relative to a horizontal plane), in such a manner that the knee angle θ of the user 2 is 140°, an angle at which exercise is highly effective.

The drive device 5 rests on a lift base 124. This lift base 124 is slidable within a strut 125 of the shank 6. The height from the foot rests 8 and the floor face of the seat 4 can be modified, and the strut 125 can be tilted backwards, through sliding of the lift base 124, so that the horizontal distance from the foot rests 8 is modified accordingly. As a result, the lower end 127*a* of a lift mechanism 127 is mounted on the pedestal 13, an upper end 127*b* of the lift mechanism 127 is mounted on the rear face of a platform 124*a* of the lift base 124, and guide rollers 124*b* provided on the outer peripheral face of the lift base 124 run along guide rails 125*a* formed in the strut 125. Extension of the lift mechanism 127 causes the height from the foot rests 8 and the floor face of the seat 4 to increase, and the horizontal distance from the foot rests 8 to become wider. Retraction of the lift mechanism 127 causes the above-mentioned height to decrease, and the above-mentioned horizontal distance to narrow.

The lift mechanism 127 comprises a pair of strut pieces 127*c*; an operating piece 127*d* housed between the strut pieces 127*c*; a gear box 127*e* mounted on the upper parts of the strut pieces 127*c*; a motor 127*f* that drives the gear box 127*e*; and a height detection unit 127*g*. A lower end 127*a* of the strut pieces 127*c* is mounted on the pedestal 13. The gear box 127*e* is mounted on the upper end of the strut pieces 127*c*. The operating piece 127*d* consisted of a ball screw and the like. The upper end 127*b* of the operating piece 127*d* is mounted on the mounting piece 124*x* (see FIG. 5 below) of the platform 124*a* of the lift base 124. A lower portion than the upper end 127*b* of the operating piece 127*d* can pass through the gear box 127*e*. An internal thread formed on the inner peripheral wall of a gear, not shown, of the gear box 127*e* meshes with the above-mentioned ball screw. The gear is driven by a worm gear fixed to the output shaft of the motor 127*f*, whereby the operating piece 127*d* extends/retracts between the strut pieces 127*c*, causing thereby the seat 4 to rise and fall.

To detect the height of the seat 4, the height detection unit 127*g* reads, by way of a sensor 127*j*, the displacement of a slit plate 127*i* coupled to the operating piece 127*d* via a connecting piece 127*h*.

A lift cover 128 is mounted on the platform 124*a* of the lift base 124, in such a manner that the lift base 124 is not exposed beyond the strut 125 even when the lift mechanism 127 is extended. A mechanism cover 129 is mounted on the platform 124*a*. As a result, the drive device 5 is protected and prevented from being exposed. A main body-side circuit board 110 is placed on the platform 124*a* of the lift base 124. A heavy power source transformer 132 or the like is stored in the strut 125, on the pedestal 13.

Figure 4:
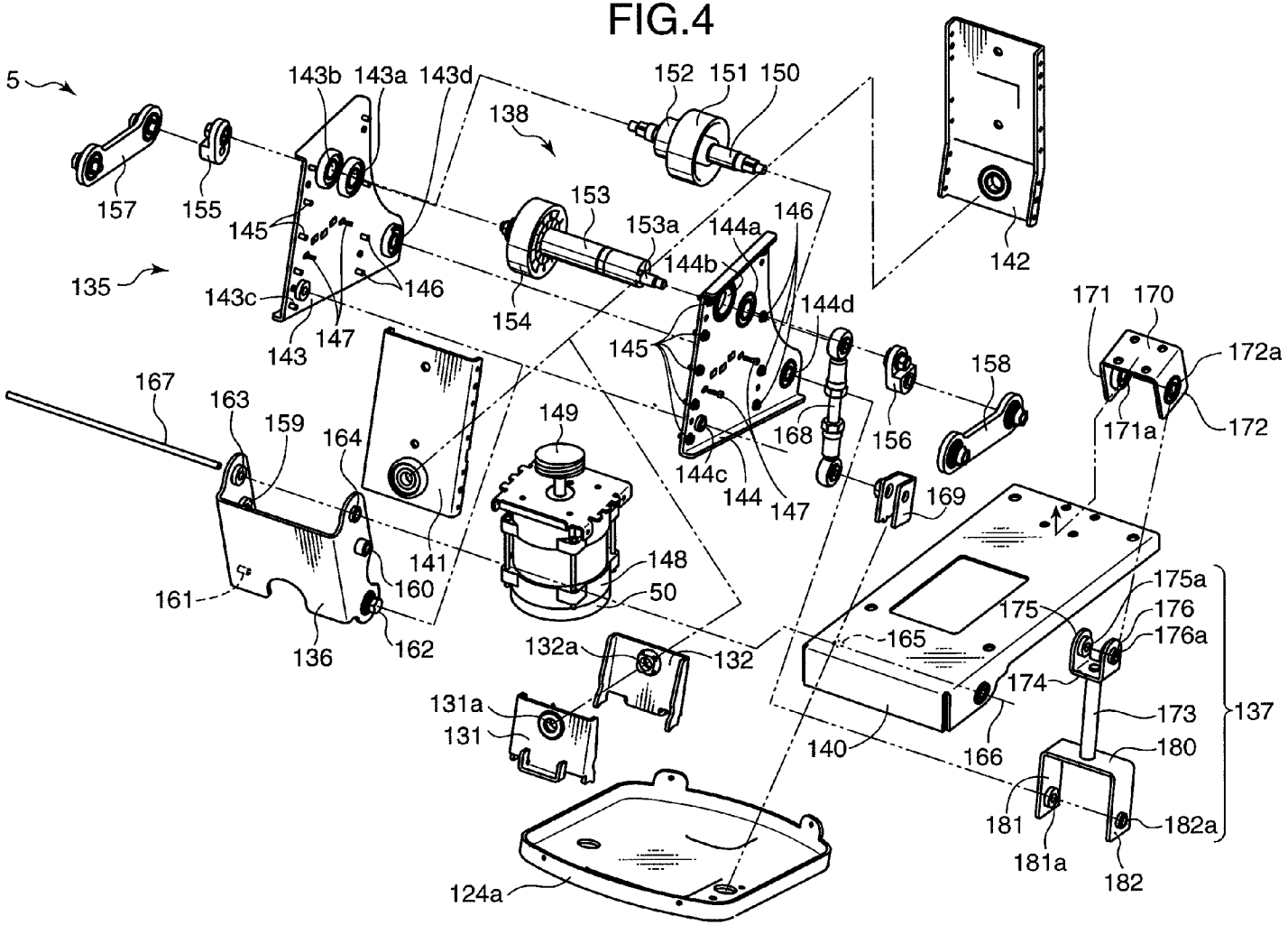
FIG. 4 is an exploded perspective-view diagram illustrating the detailed construction of a drive device for generating swinging.
Figure 5:
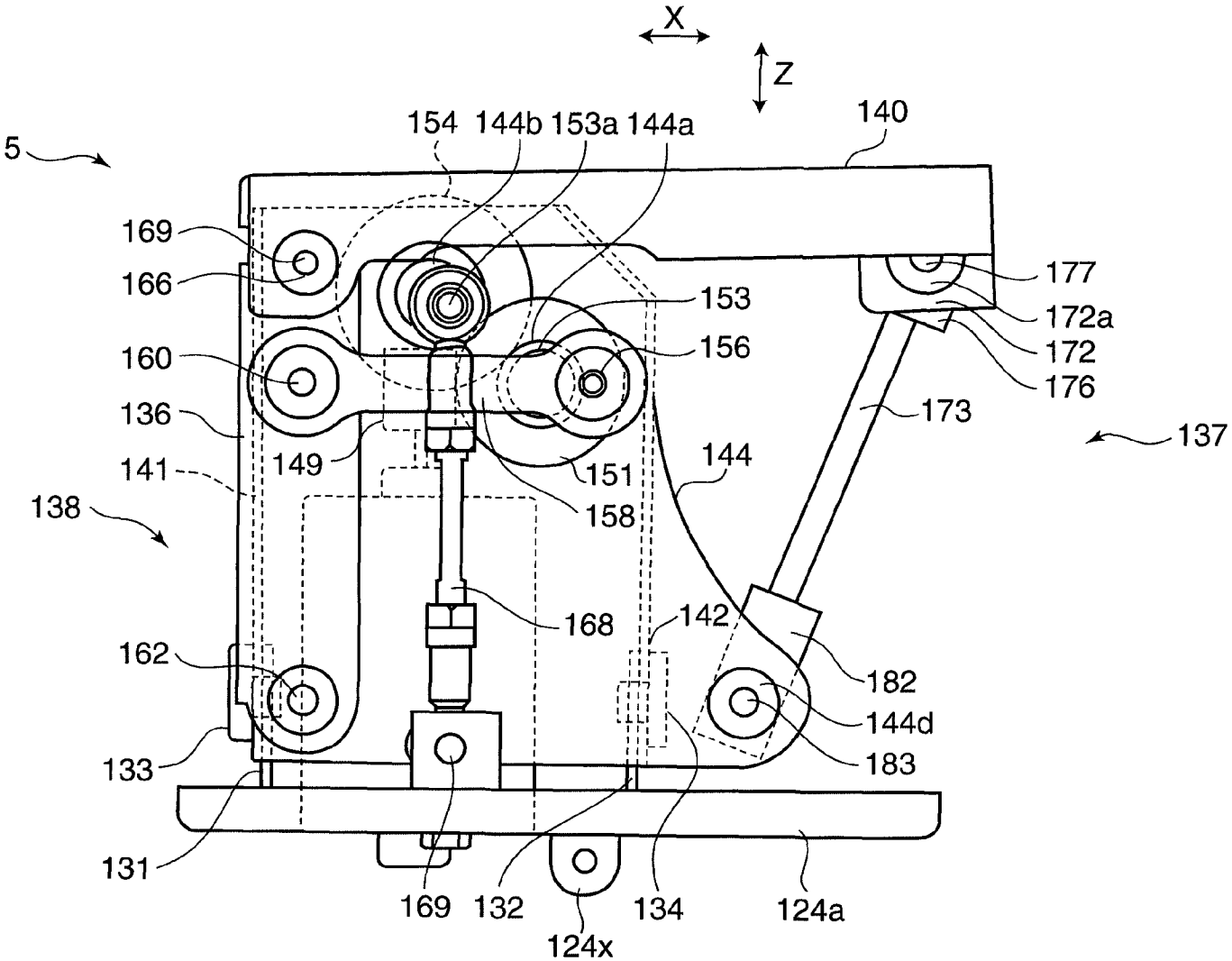
FIG. 5 is a side-view diagram of the drive device when assembled.

FIG. 4 is an exploded perspective-view diagram illustrating the detailed construction of the drive device 5. FIG. 5 is a side-view diagram of the drive device 5 when assembled. For a better understanding, some of the parts have been omitted in FIG. 5. In the drive device 5, the platform 124*a* of the lift base 124 is a swinging pedestal that does not move other than through displacement by the lift mechanism 127.

With reference to FIG. 1, a pair of pivot shaft plates 131, 132 are erected at the front and rear above the platform 124*a*. A swinging mechanism 135 can swing in the left-right direction, as denoted by the reference symbol N, by way of pins 133,134 inserted through bearings 131*a*, 132*a* of the pivot shaft plates 131, 132. A platform 140 that supports the seat 4 can swing forward and backward, as denoted by the reference symbol X, by way of a front link 136 and a rear link 137 that are supported by the swinging mechanism 135. A driving unit 138 is stored in the space surrounded by the platform 124*a*, the front link 136, the platform 140 and the rear link 137.

A front plate 141 is swingably supported, in the left-right direction, on a bearing 131*a* of the front-side bearing plate 131, by way of a pin 133. Similarly, a rear plate 142 is swingably supported, in the left-right direction, on a bearing 132*a* of the rear-side bearing plate 132, by way of a pin 134. Left and right side plates 143, 144 are fixed to the plates 141, 142 by way of screws 145, 146. The above constitutes a chassis of the swinging mechanism 135 as a movable frame.

A motor 148 is fixed to the two side plats 143, 144 by way of a screw 147. The motor 148 is erected in the swinging mechanism 135, so that the output rotation shaft of the motor 148 protrudes upwards. A screw gear 149 fixed to the output rotation shaft of the motor 148 meshes with a first gear 151 provided in a first shaft 150. A second gear 152 provided in the first shaft 150 meshes with a gear 154 provided in a second shaft 153. An encoder 50 is mounted on the motor 148. The encoder 50 detects the rotation of the above-mentioned output rotation shaft. The shafts 150,153 pivot on the bearings 143*a*, 144*a*; 143*b*, 144*b* of the side plates 143, 144.

The two ends of the first shaft 150 are formed to a prism shape, and have mounted thereon eccentric cranks 155, 156 at angles having the same phase. First ends of respective arm links 157, 158 are mounted on the eccentric cranks 155, 156. The second ends of the arm links 157, 158 are coupled to shaft pins 159, 160 provided left and right in the upper portion of the front link 136. Shaft pins 161, 162 provided left and right in the lower portion of the front link 136 are rotatably supported on bearings 143*c*, 144*c* provided at the front lower side of the two side plates 143, 144. The shaft 167 is rotatably supported on bearings 163, 164 provided left and right in the upper portion of the front link 136, and bearings 165, 166 provided left and right on the front end of the platform 140. Therefore, the rotation force of the first shaft 150 upon rotation of the motor 148 is converted to a linear reciprocating movement by the eccentric cranks 155,156 and arm links 157,158, as a result of which the platform 140 can swing in the front-rear direction as indicated by the reference symbol X.

By contrast, a pin 153*a* is eccentrically and standlingly provided at one end of the second shaft 153. An end of an eccentric rod 168 is coupled the pin 153*a*. The other end of the eccentric rod 168 is swingably coupled to a connecting fixture 169 mounted on the platform 124*a*. In FIGS. 4 and 5, the pin 153*a* and the eccentric rod 168 are provided on the left side of the swinging mechanism 135, but may also be provided on the right side. Alternatively, the pin 153*a* may be provided at positions shifted by 180° relative to each other, at both ends of the second shaft 153, on both sides of the swinging mechanism 135. Therefore, the rotation force of the second shaft 153 upon rotation of the motor 148 is converted to a linear reciprocating movement by the pin 153*a* and the eccentric rod 168, as a result of which the swinging mechanism 135 that supports the platform 140 can swing in the left-right direction as indicated by the reference symbol N.

The rear link 137 supports the rear portion of the platform 140 and the lower rear ends of both side plates 143, 144 in such a manner that the platform 140 is swingable in the front-rear direction as indicated by the reference symbol X. To this end, the rear face of the rear portion of the platform 140 has fixed thereto a U-shaped coupling piece 170. A pin 177 is pivotably supported on bearings 171*a*, 172*a* provided in hanging portions 171,172 on both sides of the coupling piece 170, and on bearings 175*a*, 176*a* provided in raised portions 175,176 on both sides of a U-shaped coupling piece 174 mounted on the top end of the shaft 173 of the rear link 137. Bearings 143*d*, 144*d* are provided on the lower rear end of both side plates 143, 144. A pin 183 is pivotably supported on bearings 181*a*, 182*a* provided at the lower end of a pair of mounting pieces 181,182 to the left and right of a reverse-U-shaped coupling piece 180 attached to the lower end of the shaft 173.

The seat 4 can thus be swung in various trajectories, such as V-shaped, W-shaped or truncated chevron-shaped trajectories, by setting the gear ratio of the gears 152,154 and the phase difference between the eccentric cranks 155,156 and the pin 153*a*, in the swinging mechanism 135. When the swinging mechanism 135 swings forward as illustrated in FIG. 2B, the seat 4 pushes out the buttocks and lumbar portion of the user 2, resting on the receiving portion 4*a*, towards the front, thereby making it harder for the thighs to exert a load on the receiving portion 4*a*, but without the thighs slipping along the raised portion 4*c* and the cutouts 4*b*. The user 2 stiffens as a result on the foot rests 8, and can thus be made to exercise.

Figure 6:
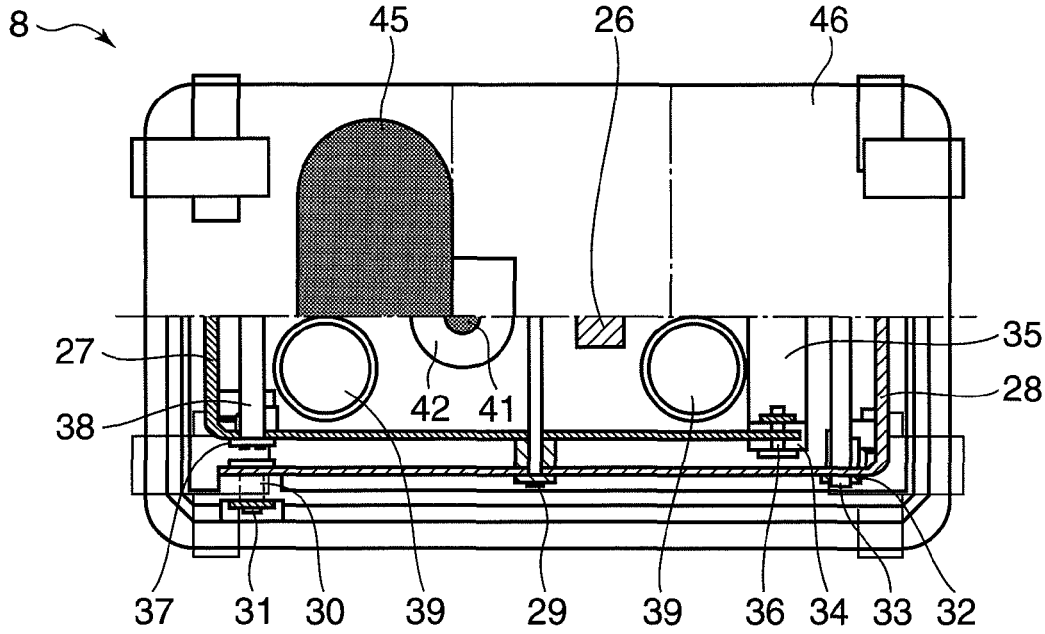
FIG. 6 is a plan-view diagram illustrating a partial cutaway view of a foot rest of the exercise assist device.
Figure 7:
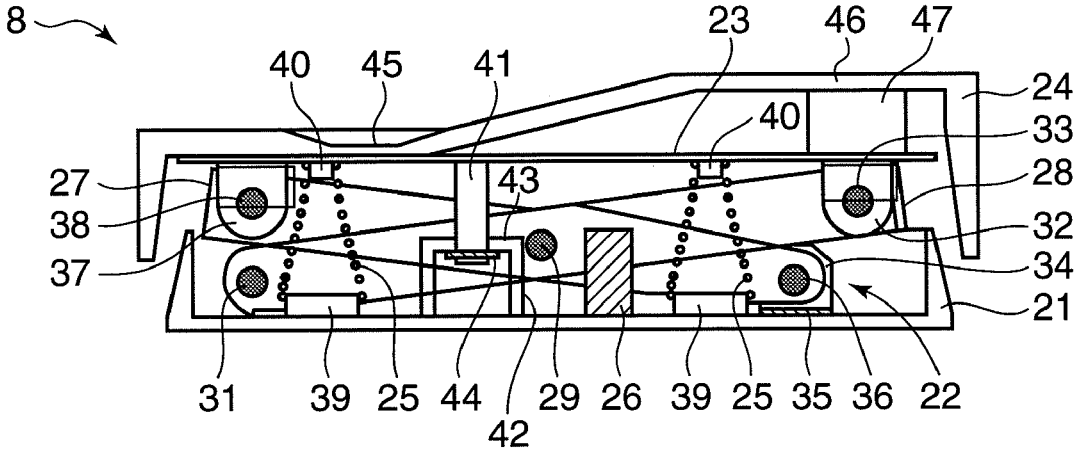
FIG. 7 is a vertical cross-sectional diagram of the foot rest.

FIG. 6 is a plan-view diagram illustrating a foot rest 8 with part thereof cut away. FIG. 7 is a vertical cross-sectional diagram of the foot rest 8. Broadly, the foot rest 8 comprises, on the pedestal 13, a base 21 slidable on a guide rail 20 in accordance with the height of the user 2; a lift mechanism 22 stored in the base 21; a frame 23 that is displaced up and down parallelly to the base 21, by the lift mechanism 22 that extends and retracts pantographically; a step 24 mounted on the frame 23; a spring 25 that urges the frame 23 upwards; and a limit switch (a detector) 26 that detects when a load equal to or greater than a predetermined value acts on the step 24.

The lift mechanism 22 comprises levers 27, 28 formed broadly as a U-shape, in a plan view, and disposed in such a manner that the recesses thereof oppose each other; a pin 29 coupled so as to allow varying the angle at which the levers 27, 28 intersect each other, at the central point of the upper and lower strokes of the U-shape; a pair of brackets 30 erected on the base 21, and which receives a free end side of the first lever 28; a pin 31 that pivotably supports a free end of the lever 28 on the brackets 30; a pair of brackets 32 formed hanging down the frame 23, and which receives the base end side of the lever 28; a pin 33 that pivotably supports the base end of the lever 28 on the brackets 32; a sliding member 35 that slides over the base 21 and which has a pair of brackets 34 that receives a free end side of the second lever 27; a pin 36 that pivotably supports a free end of the lever 27 on the brackets 34; a pair of brackets 37 formed hanging down the frame 23, and which receives the base end side of the lever 27; and a pin 38 that pivotably supports the base end of the lever 27 on the brackets 37.

The spring 25 is provided singly or as a plurality of thereof (in the example of FIGS. 6 and 7, as four springs at the front, rear, left and right respectively). When there is provided a plurality of springs 25, the total number thereof corresponds to a load of predetermined value. The springs 25 comprise each a coil spring the diameter whereof decreases towards the top. The springs 25 are fitted each between a boss 39 erected on the base 21 and a boss 40 erected on the frame 23.

In the absence of a load, the springs 25 push the frame 23 upwards. To restrict the amount of lift of the base 21 off the frame 23, a pin 41 is erected on the frame 23 side and a guide barrel 42 is erected on the base 21. The above-mentioned amount of lift is limited through locking of an outward flange 44, provided at the leading end of the pin 41, onto a flange 43 provided at the leading end of the guide barrel 42.

The step 24 has a recess 45 that receives the ball of the foot, and a raised shoulder 46 that receives the heel. A height-adjusting spacer 47 is interposed between the rear side of the shoulder 46 and the frame 23.

By virtue of the above construction, the step 24 sinks slowly and evenly (substantially horizontally) regardless the position of the step 24 that is stepped on. The left and right foot rests 8 are equivalent. When necessary in the explanation below, they will be distinguished using the reference numerals 8L and 8R. Otherwise, they will be denoted simply by the reference numeral 8.

Figure 8:
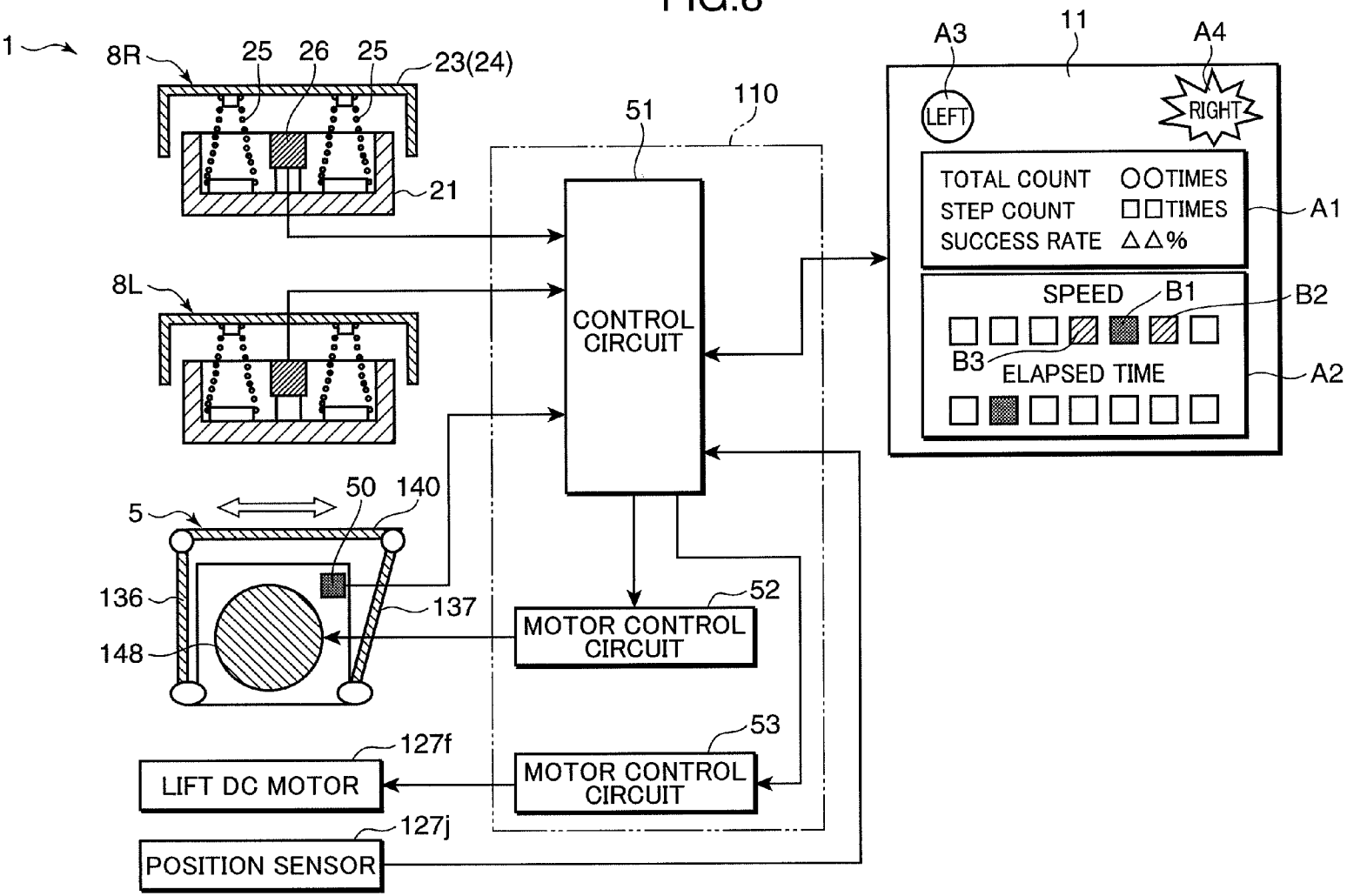
FIG. 8 is a block diagram illustrating the electric configuration of the exercise assist device.

FIG. 8 is a block diagram illustrating the electric configuration of the exercise assist device 1 having the above construction. In accordance with an operation in the operation panel 11, a control circuit (a controller) 51 of the main body-side circuit board 110 drives the swing motor 148, which comprises a DC brushless motor or the like, and the lift motor 127*f*, which comprises a DC motor or the like, via motor control circuits 52, 53. The height of seat 4 resulting from the action of the motor for lifting 127*f* is detected by the sensor 127*j*. The detection result is inputted into the main body-side circuit board 110. The pulses from the encoder 50, derived from the rotation of the motor 148, are also inputted into the control circuit 51.

The control circuit 51, which is a control means comprising, for instance, a microcomputer and peripheral circuits thereof, counts (integrates) the number of pulses from the encoder 50, to allow calculating thereby a cumulative rotation count, i.e. the number of swings, since exercise begins. The swinging speed can be calculated by counting (integrating) the number of pulses per unit time. The swinging count is displayed on a display area A1 of the operation panel 11, and the swinging speed and the elapsed time of operation are displayed on a display region A2.

In the present embodiment, it should be noted, the output from the limit switch 26 of the left and right foot rests 8L, 8R is also inputted into the control circuit 51. When the step 24 is stepped upon with a load equal to or greater than a predetermined value, i.e. when exercise is successful, the limit switch 26 is turned on. As long as the stepping persists, the control circuit 51 causes display lamps A3, A4, corresponding to the left and right foot rests 8L, 8R, to be lit (the lamp lit in FIG. 8 indicates stepping by the right foot). The control circuit 51 counts (integrates) the total swing count and cumulative count of turning-on times since the start of exercise, and causes the total count and the step count to be displayed on the display area A1. The proportion of cumulative number of turn-on times relative to the total swing count, i.e. the success rate, is displayed on the display area A1. The operation panel 11 consists of a touch panel. The user 2 can adjust the speed in accordance with the results displayed on the touch panel, by increasing the speed, as indicated by the reference numeral B2, or reducing the speed, as indicated by the reference numeral B3, on the basis of the current speed indicated by the reference numeral B1, in such a manner so as to increase the success rate.

A desired exercise result cannot be obtained when the weight applied to the seat 4 by the user 2 is excessive. This can be determined depending on whether the limit switch 26 is not turned ON. Therefore, a greater proportion of times that the limit switch 26 is turned ON correlates with a higher success rate, and indicates that the load resulting from the body weight is applied to the leg 7 and stepping is good. By contrast, a lower success rate indicates that the load resulting from the body weight is not applied to the leg 7 and hence stepping is poor.

Since the main users of the exercise assist device 1 are patients of life-style diseases or elderly users, as described above, the load of the above-mentioned predetermined value is set, for instance, to 16 kg, which is 40% of the level at which exercise is successful (i.e. sufficient load is applied to the leg 7), out of 40 kg, which is the lowest conceivable body weight for an adult.

It should also be noted that the control circuit 51 modifies the way of swinging of the seat 4 in accordance with the success rate. Specifically, the control circuit 51 modifies, via the motor control circuit 52, the rotational speed of the motor 148 of the drive device 5 that is a swinging means (a swinging unit). As the success rate increases and stepping improves, the swinging speed and the amount of exercise per unit time increase as well. As the success rate decreases, the swinging speed is slowed down to enable good stepping, and the exercise time is prolonged in order to achieve the intended amount of exercise.

Figure 9:
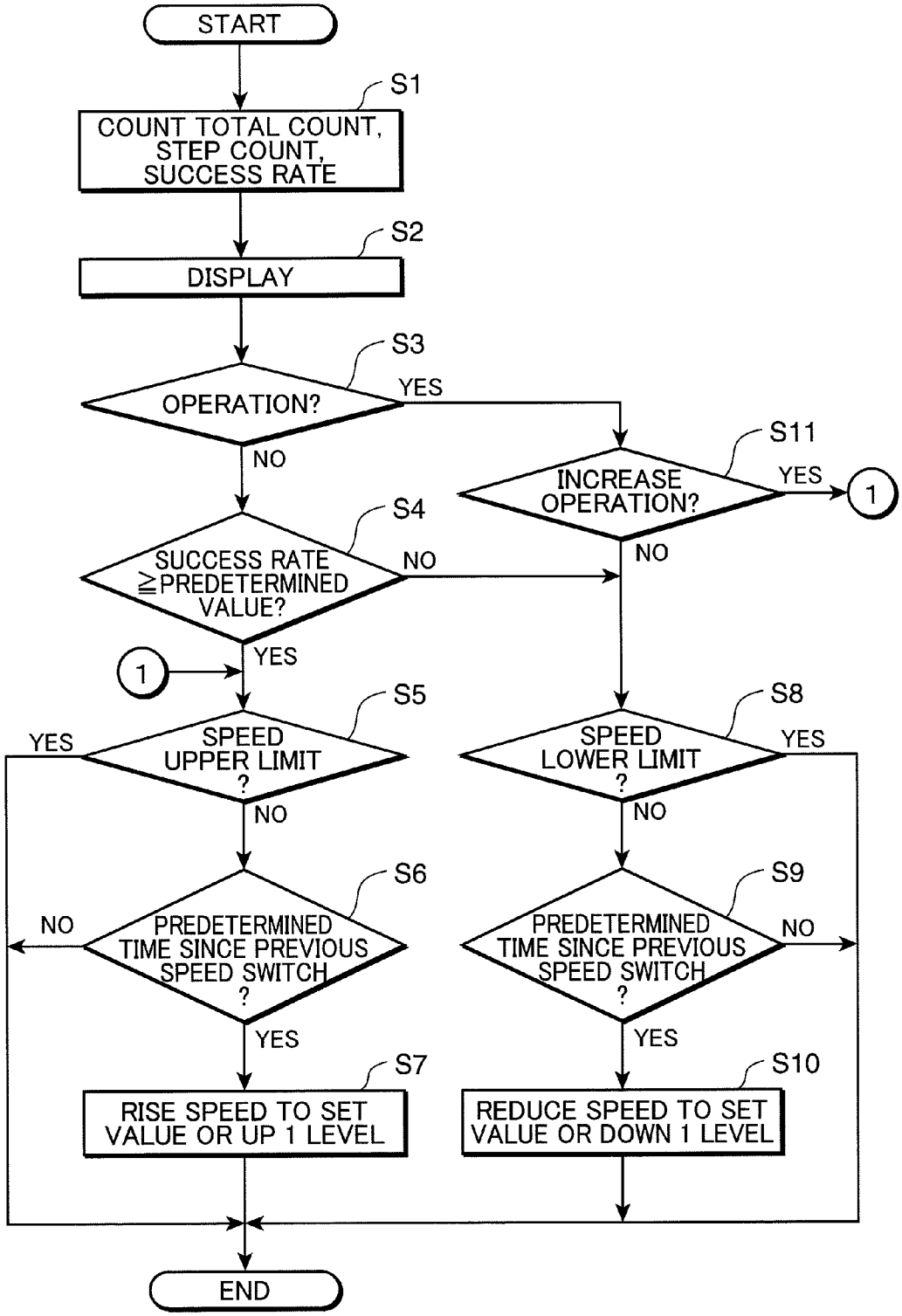
FIG. 9 is a flowchart for explaining the operation of a control circuit.

FIG. 9 is a flowchart for explaining the operation of the control circuit 51. The total swing count, the step count and the success rate obtained in step S1 are displayed on the display area A1 in step S2. In step S3, it is determined whether the operation panel 11 has been operated or not. If not so, the process proceeds to step S4. In step S4 it is determined whether the success rate is at a predetermined level. If so, the process proceeds to a speed raising process from step S5 onwards. Else, the process proceeds to a speed lowering process from step S8 onwards.

In step S5 it is determined whether a set speed has reached yet an upper limit value. When the upper limit value has been reached, the process ends. Else, the process proceeds to step S6. In step S6 it is determined whether a predetermined time has elapsed since a previous speed switch. If no such time has elapsed, the process ends. When the predetermined time has elapsed, the process proceeds to step S7, where the speed is raised to a set value, set via the operation panel 11, or is raised to a speed one level higher than the current speed, whereupon the process ends.

In step S8 it is similarly determined whether a set speed has reached yet a lower limit value. When the lower limit value has been reached, the process ends. Else, the process proceeds to step S9. In step S9, it is determined whether a predetermined time has elapsed since a previous speed switch. If no such time has elapsed, the process ends. When the predetermined time has elapsed, the process proceeds to step S10, where the speed is lowered to a set value, set via the operation panel 11, or is lowered to a speed one level lower than the current speed, whereupon the process ends.

Meanwhile, when in step S3 the operation panel 11 has been operated, the process proceeds to step S11, where it is determined whether the operation is an increase operation or a decrease operation. In case of an increase operation, the process proceeds step S5 above. In case of a decrease operation, the process proceeds to step S8 above.

The control circuit 51 modifies thus the swinging speed of the seat 4 in accordance with the success rate. The exercise assist device 1 can automatically determine thereby the degree of proficiency of the user 2, and can effectively impose exercise in accordance with that degree of proficiency. On the basis of the display of the total swing count and the step count (amount of exercise), the user 2 can check whether the amount of exercise has been attained as anticipated or as targeted. The user 2 can then, for instance, change the way in which the load resulting from body weight is applied, to afford better stepping, and can increase the amount of exercise by increasing the swinging speed or by prolonging the exercise time. Also, the success rate display allows the user 2 to check not only the amount of exercise but also whether he/she is stepping well or not, so that exercise can be performed yet more effectively.

The above-described drive device 5 is configured in such a manner so as to make the swinging speed variable, but may also be configured so as to make the stroke variable, or so as to make both swinging speed and stroke variable. Integrative counting of cumulative number of times may be performed by the control circuit 51 not only from the start of exercise, but also the count may be arbitrarily reset at predetermined interval of time, to integrate the cumulative number of times for every predetermined period of time. The limit switch 26 may be set to count the turn-on duration, and not the number of turn-ons. In that case, the success rate is the proportion of time that the limit switch 26 is turned on, per unit time or relative to the elapsed time.

Embodiment 2

Figure 10:
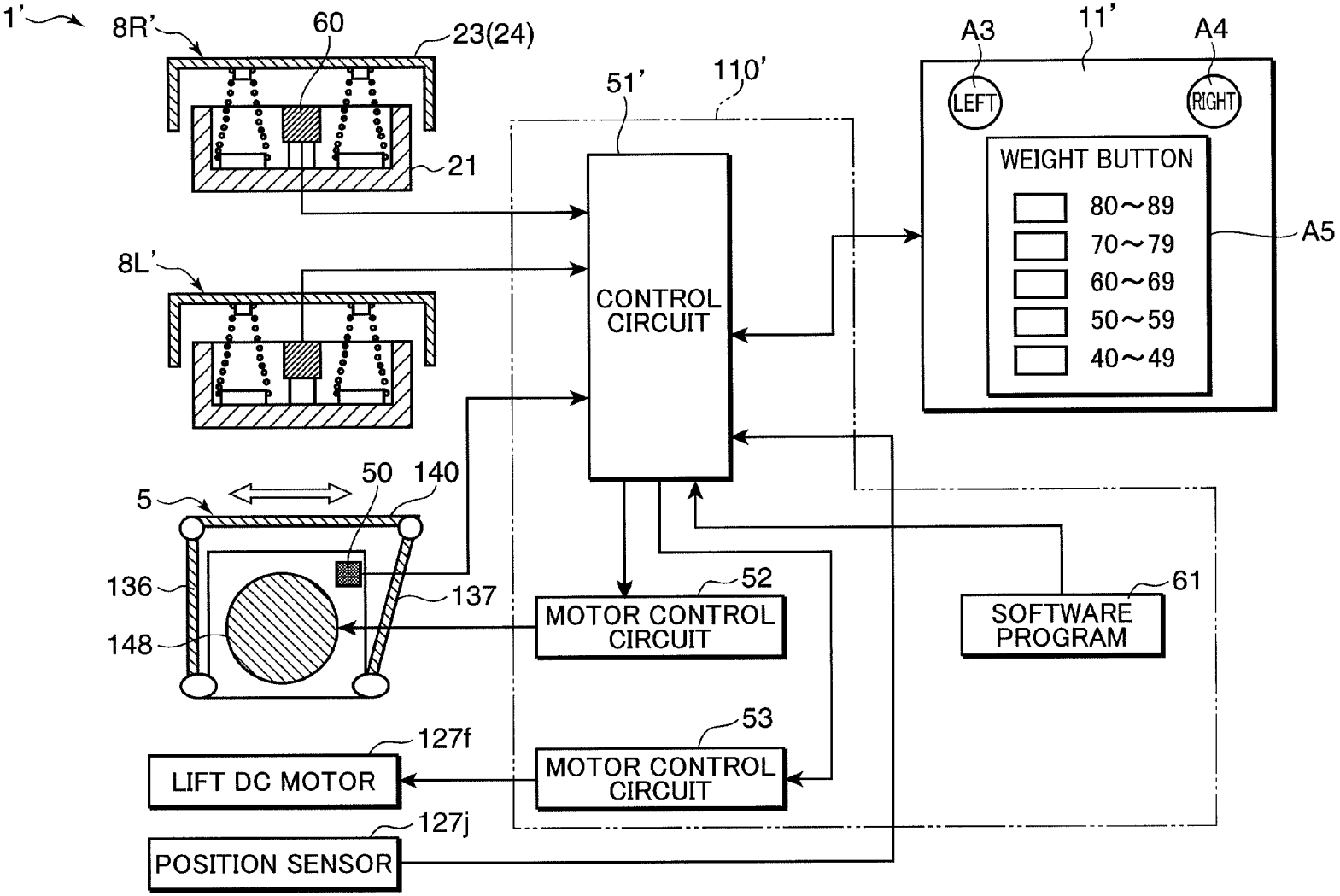
FIG. 10 is a block diagram illustrating the electric configuration of an exercise assist device according to another embodiment of the present invention.

FIG. 10 is a block diagram illustrating the electric configuration of an exercise assist device 1' according to another embodiment of the present invention. The exercise assist device 1' is similar to the above-described exercise assist device 1. Hence, corresponding portions are denoted with identical reference numerals and a recurrent explanation thereof will be omitted. In the present embodiment, it should be noted, a load sensor (a detector) 60 has been provided in left and right foot rests 8L', 8R', in lieu of the limit switch 26. The limit switch 26 only detects ON/OFF, and can merely determine whether the applied weight is equal to or greater than the above-described predetermined value. By contrast, the load sensor 60 consists of a variable resistor, a strain gauge or the like and can detect the extent to which load resulting from body weight is applied.

In an operation panel 11', meanwhile, a body weight input screen such as the one depicted in the display area A5 can be displayed, at the beginning of exercise, instead of the display screen illustrated in FIG. 8. A control circuit 51' of the main body-side circuit board 110' displays a body weight input screen. On the basis of the input via the body weight input screen, the control circuit 51' switches the value of 40% of the body weight, which is the exercise result criterion, in accordance with the user 2. The control circuit 51' determines whether exercise is successful according to the criterion above and in response to input from the load sensor 60. The control circuit 51' causes the display lamps A3, A4 to lit up, and performs a count operation. The weight input screen need not involve direct input of body weight by the user 2, as in the case of FIG. 10. Alternatively, the screen may prompt a measurement operation according to which the user 2 loads his/her entire body weight on the foot rests 8L', 8R', whereupon the load sensor 60 measures the resulting load.

In such a configuration, the value of 40% of the body weight, as an exercise result criterion, can be switched depending on the user 2. The above 40% criterion can also be appropriately changed.

A software program 61 is installed in the main body-side circuit board 110'. For instance, the control circuit 51' performs, in accordance with the software program 61, an alterness test that involves stepping in response to a display on an operation panel 11'. On the basis also of the software program 61, the control circuit 51' performs operations directed at increasing enjoyment of exercise by the user 2, for instance by changing the swinging speed and/or displaying an encouragement screen when the success rate is low.

Figure 11:
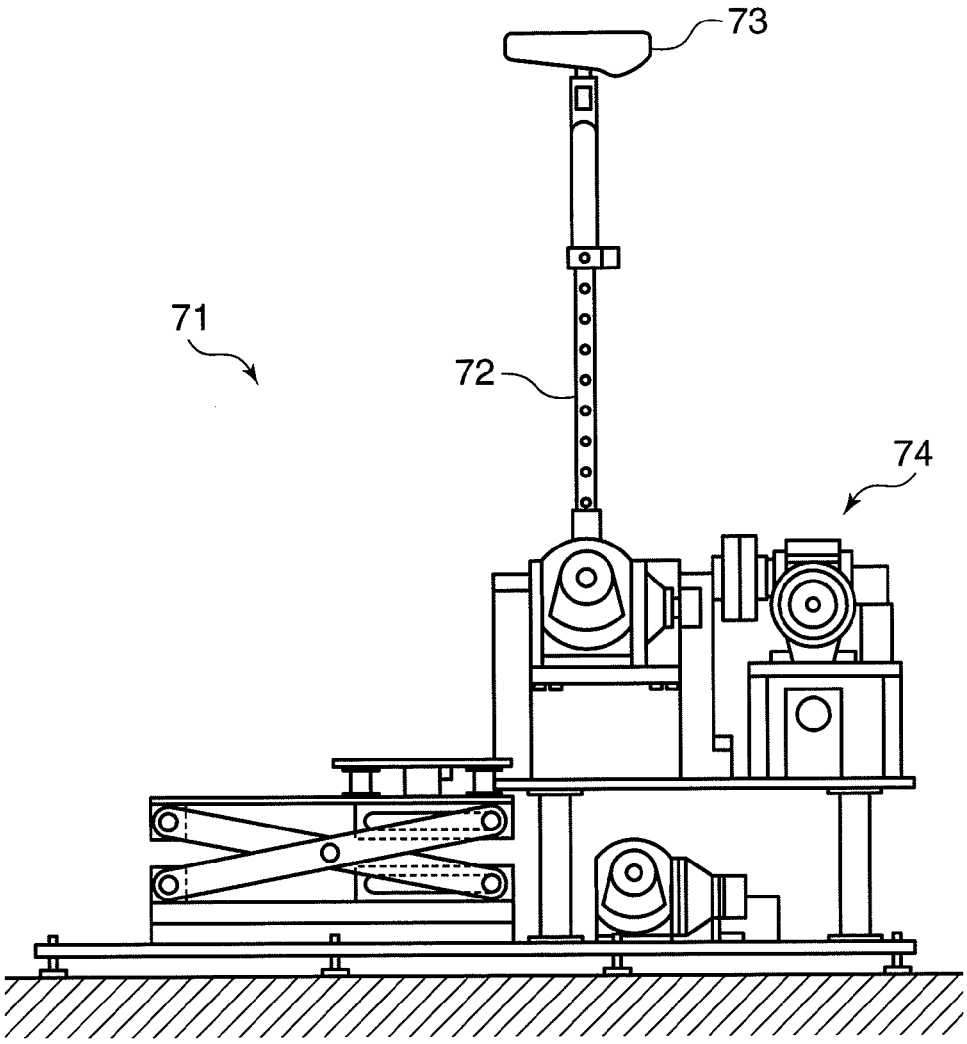
FIG. 11 is a front-view diagram illustrating the configuration of a conventional exercise assist device.

The exercise assist device 1, 1' of the present invention has a drive device 5, for swinging generation, mounted on a telescopic shank 6 that is erected on a pedestal 13, and the seat 4 mounted on the drive device 5. By contrast, an exercise assist device 71 of Patent Document 1 has a seat 73 mounted on the leading end of a pole 72, as illustrated in FIG. 11, such that the base end side of the pole 72 is swung by a drive device 74. As a result, the base end side is subjected to substantial stress.

Therefore, the exercise assist device 1, 1' of the present invention can use small parts and be driven with less power consumption, while allowing the height of the seat 4 to be adjusted easily.

As thus described, an exercise assist device according to the present invention is an exercise assist device having a swinging unit for swinging a seat, with the lumbar portion of a user placed on the seat, so that the user puts a variable load resulting from body weight of the user on the legs on foot rests, and thereby allowing the user to exercise, the exercise assist device comprising: a detector for detecting that a load equal to or greater than a predetermined value is acting on the foot rest; and a controller for modifying the way, in which the swinging unit swings the seat, in accordance with the proportion of, over a predetermined number of swings, the number of times that the detector detects that the user puts on the legs a load equal to or greater than the predetermined value, or in accordance with the proportion of, within a predetermined time, time that the detector detects that the user puts on the legs a load equal to or greater than the predetermined value.

In the above configuration, a swinging unit for swinging a seat, with the lumbar portion of a user placed on the seat, so that the user puts a variable load resulting from body weight of the user on the legs on foot rests, whereby the exercise assist device allows the user to exercise. Desired exercise results cannot be obtained when the user puts too much weight on the seat during swinging of the user. Therefore, there is provided a detector for detecting that a load equal to or greater than a predetermined value is applied to the foot rests, i.e. for detecting whether exercise is successful. To control swinging of the seat by the swinging unit, the controller calculates a success rate on the basis of the detection results by the detector, i.e. calculates as a success rate the proportion of, over a predetermined number of swings, the number of times that the detector detects that the user puts on the legs a load equal to or greater than the predetermined value, or the proportion of, within a predetermined time, time that the detector detects that the user puts on the legs a load equal to or greater than the predetermined value, and modifies the way, in which the swinging unit swings the seat, in accordance with the success rate.

Specifically, the higher the success rate, the greater the load resulting from body weight of the user that is put on the legs, and the better the stepping becomes. The swinging speed is increased, and the amount of exercise per unit time is increased by lengthening the swinging stroke. By contrast, the lower the success rate, the smaller the load resulting from body weight of the user that is put on the legs, and the worse the stepping becomes. The swinging speed is slowed down, and the swinging stroke is reduced, to improve stepping, or alternatively, the exercise time is prolonged in order to complete a desired amount of exercise.

Thus, the device determines automatically the degree of proficiency of the user, and allows the user to exercise effectively in accordance with his/her degree of proficiency.

The exercise assist device according to the present invention is an exercise assist device having a swinging unit for swinging a seat, with the lumbar portion of a user placed on the seat, so that the users puts a variable load resulting from body weight of the user on the legs on foot rests, thereby allowing the user to exercise, the exercise assist device further comprising: a detector for detecting that a load equal to or greater than a predetermined value is acting on the foot rests; and a display unit for integrating the detection results of the detector and displaying the integration results.

In the above configuration, a swinging unit swings a seat, with the lumbar portion of a user placed on the seat, so that the user puts a variable load resulting from body weight of the user on the legs on foot rests, whereby the exercise assist device allows the user to exercise. Desired exercise results cannot be obtained when the user puts too much weight on the seat. Therefore, there is provided a detector for detecting that a load equal to or greater than a predetermined value is applied to the foot rests, i.e. for detecting whether exercise is successful. The user can check whether the amount of exercise has been attained as anticipated or as targeted, on the basis of the amount of exercise, resulting from integrating the detection results of the detector, and displayed by the display. The user can then, for instance, change the way in which the load resulting from body weight is applied to afford better stepping, and can increase the amount of exercise by increasing the swinging speed or the swinging stroke.

The user can exercise effectively as a result.

In the exercise assist device of the present invention, preferably, the display unit displays the proportion of the number of times, over a predetermined number of swings, that the detector detects that the user puts on the legs a load equal to or greater than the predetermined value, or the proportion of time, within a predetermined time, that the detector detects that the user puts on the legs a load equal to or greater than the predetermined value.

In such a configuration, the display integrates the number of swings and the number of times that it is detected that the user puts on the legs a load equal to or greater than the predetermined value. The success rate, i.e. whether the user is stepping successfully, can be determined by obtaining the above proportions. Similarly, there is determined a proportion between a predetermined time and the time over which the user puts on the legs a load equal to or greater than the predetermined value. The success rate can be worked out based on that proportion.

Therefore, the user can check not only the amount of exercise but also whether he/she is stepping successfully or not at the time. The user can exercise yet more effectively as a result.

In the exercise assist device of the present invention, the detector is preferably a load sensor.

The above configuration, wherein the detector detects merely that a load equal to or greater than a predetermined value is acting on the foot rests, allows determining that effective exercise is being performed in the exercise assist device when a load of, for instance, 16 kg is applied to the foot rests, 16 kg being herein 40% of 40 kg, which is the lowest conceivable body weight for an adult. Whether the 16 kg are applied or not can be determined thus by providing, in the foot rests, a detector in the form of, for instance, a means for detecting ON/OFF, such as a limit switch, in a spring that urges against the 16 kg load.

The extent to which body weight is applied can be detected however by using a load sensor such as a variable resistor, a strain gauge or the like, as the detector, so that the value of 40% of the body weight, as an exercise result criterion, can be switched depending on the user. Specifically, weight data of each user is acquired beforehand by setting a weight via an operation panel, or by measuring, before exercise, the load of the entire body weight placed on the foot rests. The 40% criterion can then be appropriately modified in accordance with the resulting data.

Preferably, the exercise assist device according to the present further comprises a pedestal having the foot rests; and a strut, which is erected on the pedestal, and which maintains a predetermined gap between the seat and the foot rests, and the strut can be telescopically displaced in accordance with the height of the user; wherein the swinging unit is mounted on an upper portion of the strut, and onto an upper portion of the seating unit the seat is attached.

When realizing an exercise assist device wherein there is swung a seat, with the lumbar portion of a user placed on the seat, so that the user puts a variable load resulting from body weight of the user on the legs and cause thereby the user to exercise, the above configuration allows using smaller parts, and results in less stress being applied to various mechanical parts, than is the case in a configuration wherein the seat is attached to the leading end of a pole and it is the base end side of the pole that is swung. The above configuration, moreover, is preferred in the present invention in that it allows easily adjusting the height of the seat in accordance with the height of the user, who can then exercise yet more effectively.

In the exercise assist device according to the present, preferably, the swinging unit is realized as a drive device provided between the seat and the upper portion of the strut, and comprises a swinging mechanism being swingable around an axis in a front-rear direction relative to a platform provided on the upper portion of the strut, such that the swinging mechanism generates swinging motion in the front-rear direction; a front link and a rear link swingably supported on the swinging mechanism, in the front-rear direction; and a platform, provided between the front link and the rear link, which supports the seat.

This allows realizing the swinging unit that generates swinging in the front-rear direction and the left-right direction by way of a drive device having the above construction.

In the exercise assist device of the present invention, preferably, the swinging mechanism comprises a pair of front and rear pivot shaft plates erected on the platform; a chassis comprising a front plate and a rear plate, being swingably supported on the pivot shaft plates, in the left-right direction, by way of pins extending in the front-rear direction, and side plates fixed to both left and right sides of the front plate and the rear plate; a motor which is set longitudinally within the chassis; first and second shafts which are pivotably supported on both side plates, and which are driven by the motor; eccentric cranks which arte mounted on both ends of the first shaft, at respective angles having the same phase; arm links whose first ends are mounted to the eccentric cranks; and an eccentric rod provided between the platform and a pin eccentrically provided and erected on at least one end of the second shaft; the front link being swingably supported anteriorly and posteriorly on the lower side of the front plate, and being swingable in a front-rear direction by way of being mounted to the second ends of the arm links, and the swinging mechanism swings in the left-right direction through driving by the eccentric rod.

Upon motor driving in the above configuration, the first shaft, the eccentric cranks, the arm links and the front link cause the platform that supports the seat to swing in the front-rear direction, while the second shaft and the eccentric rod cause the platform that supports the seat to swing in the left-right direction. The platform that supports the seat can thus be swung by the swinging unit.

The invention claimed is:

1. An exercise assist device having a swinging unit for swinging a seat, with a lumbar portion of a user placed on the seat, so that the user puts a variable load resulting from body weight of the user, on legs on foot rests, thereby allowing the user to exercise, the exercise assist device comprising:

a detector for detecting that a load equal to or greater than a predetermined value is acting on the foot rests; and a controller for modifying the way, in which the swinging unit swings the seat, in accordance with proportion of, over a predetermined number of swings, the number of times that the detector detects that the user puts on the legs a load equal to or greater than the predetermined value, or in accordance with proportion of, within a predetermined time, time that the detector detects that the user puts on the legs a load equal to or greater than the predetermined value.

2. The exercise assist device according to claim 1, further comprising a display unit for integrating detection results by the detector and displaying the integration results.

3. The exercise assist device according to claim 2, wherein the display unit displays proportion of, over a predetermined number of swings, the number of times that the detector detects that the user puts on the legs a load equal to or greater than the predetermined value, or proportion of, within a predetermined time, time that the detector detects that the user puts on the legs a load equal to or greater than the predetermined value.

4. The exercise assist device according to claim 1, wherein the detector is a load sensor.

5. The exercise assist device according to claim 1, further comprising:

a pedestal having the foot rests; and a strut which is erected on the pedestal and maintains a predetermined gap between the seat and the foot rests, and which can be telescopically displaced in accordance with the height of the user; wherein the swinging unit is mounted on an upper portion of the strut, and onto an upper portion of the swinging unit the seat is attached.

6. The exercise assist device according to claim 5, wherein the swinging unit is realized as a drive device provided between the seat and the upper portion of the strut, and comprises a swinging mechanism being swingable around an axis in a front-rear direction relative to a platform provided on the upper portion of the strut, and generating swinging motion in the front-rear direction;

a front link and a rear link swingably supported on the swinging mechanism, in the front-rear direction; and a platform, which is provided between the front link and the rear link, and which supports the seat.

7. The exercise assist device according to claim 6, wherein the swinging mechanism comprises:

a pair of front and rear pivot shaft plates erected on the platform;

a chassis comprising a front plate and a rear plate, which are swingably supported on the pivot shaft plates, in a left-right direction, by way of pins extending in the front-rear direction, and side plates fixed to both left and right sides of the front plate and the rear plate;

a motor which is set longitudinally within the chassis;

first and second shafts which are pivotably supported on both the side plates, and which are driven by the motor;

eccentric cranks which are mounted on both ends of the first shaft, at respective angles having the same phase;

arm links whose first ends are mounted to the eccentric cranks; and an eccentric rod provided between the platform and a pin eccentrically provided and erected on at least one end of the second shaft, the front link being swingably supported anteriorly and posteriorly on the lower side of the front plate, and being swingable in a front-rear direction by way of being mounted to the second ends of the arm links, and the swinging mechanism swings in the left-right direction through driving by the eccentric rod.

8. An exercise assist device having a swinging unit for swinging a seat, with the lumbar portion of a user placed on the seat, so that the user puts a variable load resulting from body weight of the user, on legs on foot rests, thereby allowing the user to exercise, the exercise assist device comprising:

a detector for detecting that a load equal to or greater than a predetermined value is acting on the foot rests; and a display unit for integrating detection results by the detector and displaying the integration results.

9. The exercise assist device according to claim 8, wherein the display unit displays proportion of, over a predetermined number of swings, the number of times that the detector detects that the user puts on the legs a load equal to or greater than the predetermined value, or proportion of, within a predetermined time, time that the detector detects that the user puts on the legs a load equal to or greater than the predetermined value.

10. The exercise assist device according to claim 8, wherein the detector is a load sensor.

11. The exercise assist device according to claim 8, further comprising:

a pedestal having the foot rests; and a strut which is erected on the pedestal and maintains a predetermined gap between the seat and the foot rests, and which can be telescopically displaced in accordance with the height of the user; wherein the swinging unit is mounted on an upper portion of the strut, and onto an upper portion of the swinging unit the seat is attached.

12. The exercise assist device according to claim 11, wherein the swinging unit is realized as a drive device provided between the seat and the upper portion of the strut, and comprises a swinging mechanism being swingable around an axis in a front-rear direction relative to a platform provided on the upper portion of the strut, and generating swinging motion in the front-rear direction;

a front link and a rear link swingably supported on the swinging mechanism, in the front-rear direction; and a platform, which is provided between the front link and the rear link, and which supports the seat.

13. The exercise assist device according to claim 12, wherein the swinging mechanism comprises:

a pair of front and rear pivot shaft plates erected on the platform;

a chassis comprising a front plate and a rear plate, which are swingably supported on the pivot shaft plates, in a left-right direction, by way of pins extending in the front-rear direction, and side plates fixed to both left and right sides of the front plate and the rear plate;

a motor which is set longitudinally within the chassis;

first and second shafts which are pivotably supported on both the side plates, and which are driven by the motor;

eccentric cranks which are mounted on both ends of the first shaft, at respective angles having the same phase;

arm links whose first ends are mounted to the eccentric cranks; and an eccentric rod provided between the platform and a pin eccentrically provided and erected on at least one end of the second shaft, the front link being swingably supported anteriorly and posteriorly on the lower side of the front plate, and being swingable in a front-rear direction by way of being mounted to the second ends of the arm links, and the swinging mechanism swings in the left-right direction through driving by the eccentric rod.

* * * * *